US005494509A

United States Patent [19]

Kruythoff et al.

[11] Patent Number: 5,494,509

[45] Date of Patent: Feb. 27, 1996

[54] PAPER COATING COMPOSITION WITH INCREASED THICKENER EFFICIENCY

[75] Inventors: Dirk Kruythoff, Papendrecht; Andre H. Van Waveren, Pynacker, both of Netherlands

[73] Assignee: Aqualon Company, Wilmington, Del.

[21] Appl. No.: 143,094

[22] Filed: Oct. 29, 1993

[51] Int. Cl.[6] ..... C09D 101/28

[52] U.S. Cl. ..... 106/197.1; 106/157; 106/158; 106/162; 106/188; 106/189; 162/164.1; 162/174; 162/176; 162/177

[58] Field of Search ..... 106/157, 158, 106/162, 188, 189, 197.1; 162/174, 176, 177, 164.1

[56] References Cited

U.S. PATENT DOCUMENTS 5,080,717 1/1992 Young ..... 106/158

5,258,069 11/1993 Knechtel ..... 102/192.1

*Primary Examiner*—David Brunsman

*Attorney, Agent, or Firm*—David Edwards

[57] ABSTRACT

A paper coating composition is provided having a clay-containing pigment system, a binder, a polysaccharide thickener, and at least 0.005% to 2%, based upon the weight of the polymer, of a blocking agent that serves to prevent more than 25% of the polysaccharide thickener from being adsorbed onto the clay pigment surface. This coating is applied to raw paper for producing a high quality paper with smooth and substantially free of indentations surfaces for good ink to paper transfer.

7 Claims, No Drawings

PAPER COATING COMPOSITION WITH INCREASED THICKENER EFFICIENCY

FIELD OF THE INVENTION

This invention relates to a paper coating composition utilizing nonionic thickeners and in particular a paper coating composition having a clay-containing pigment system which shows improved coating efficiency and runnability and which shows only minimal pigment shock.

BACKGROUND OF THE INVENTION

In order to obtain high quality paper, it is necessary that the surface of the paper is smooth and substantially free of indentations or valleys. Smooth papers are a prerequisite for good images printed thereon and also for good transfer of ink to paper. Smooth papers are obtained by coating the raw paper surface with a pigment composition. The coating composition to effect this is an aqueous dispersion comprising mainly of mineral pigments such as clay, calcium carbonate, or titanium oxide, and pigment binders of natural protein, for example, casein or soy protein, starch, or synthetic polymer emulsions. Coating compositions are usually applied to a continuous web of material by high speed coating machines, such as blade coaters, air knife coaters, rod coaters and roll coaters. The flow properties of coating color compositions for paper and boards are of significant importance with regard to the runnability (or flow) of the color during the coating operation. These flow properties are often controlled by a "thickener" or "co-binder", which terms are taken to be synonymous in the industry.

In preparing the coating color, the thickener is mixed with the pigment slurry. This may result in what is known in the industry as "pigment shock", due to a strong transient adsorption of the thickener onto the pigment. This causes a rapid increase in viscosity during the early stages of thickener addition. This pigment shock may result in flocculation of the pigment, pigment agglomeration, difficulty in mixing due to momentary solidification of such a pigment slurry, and in severe cases, complete coagulation. Industrial practice cannot tolerate such a phenomenon. Furthermore, when this occurs, the thickener is rendered partially inactive, resulting in less water retention and unsatisfactory rheology before, under, and after the blade. As a consequence, corrective actions during the coating operation are often necessary.

U.S. Pat. No. 4,879,336 discloses an approach to solving the above mentioned problem of pigment shock by mixing clay slurries with a butadiene styrene latex composition when certain poly(vinyl alcohol) copolymers are present in the latex. Another approach to the problem is mentioned in U.S. Pat. No. 3,558,543 that discloses a method of reducing initial thickening (pigment shock) of paper coating when a clay or pigment slurry is mixed with an adhesive solution. This patent uses polyvinyl pyrrolidine mixed with poly(vinyl alcohol) adhesive solutions to eliminate the pigment shock. This reference also discloses that the severity of pigment shock is particularly pronounced when the adhesive is protein material or poly(vinyl alcohol) (see column 1, line 61–63.

U.S. Pat. No. 4,994,112 discloses a paper coating composition containing a water soluble hydrophobically modified hydroxypropylcellulose thickener that has been modified with an alkyl or aralkyl group having preferably 12 to 16 carbons atoms. This thickener enables the paper coating to be applied uniformly at high machine speeds. Another approach to providing a paper coating composition is disclosed in U.S. Pat. No. 5,080,717 which discloses an aqueous paper coating composition comprising clay, a latex, and a thickener of a multi polysaccharide suspension of a hydrophobically modified alkyl hydroxyalkyl cellulose suspended in a low molecular weight polysaccharide and a salt.

None of this prior art discloses nor suggests the instant invention.

SUMMARY OF THE INVENTION

This invention relates to a method for mixing coating color ingredients wherein thickeners like nonionic polysaccharides and pigment portions are combined in a manner which increases thickener efficiency and runnability and simultaneously eliminates pigment shock by using a second water soluble polymer having a limited low molecular weight which preferentially adsorbs onto the pigment, blocking the adsorption of the main thickener. This second water soluble polymer will be referred to as a "blocker".

This improved method for preventing momentary solidification during preparation of a clay containing paper coating composition comprises the preparation of an aqueous coating composition with said co-binder/blocker combination, pigment and binder. The blocker is selected from the group of nonylphenol ethoxylates, low molecular weight poly(vinyl alcohol), low molecular weight poly(ethylene) oxide, or proteins.

This invention also comprehends a process for paper coating comprising applying the above-mentioned composition to a paper web, removing the excess composition from the web to provide a uniform coating composition and drying the coating to produce a paper product.

DETAILED DESCRIPTION OF THE INVENTION

The paper coating industry is always seeking improved productivity. It is known that nonionic polysaccharides like hydroxyethylcellulose (HEC), when used in a clay based paper coating give improved results regarding coating holdout and required dosage when compared to conventional thickeners like carboxymethylcellulose (CMC) and polyacrylates.

This performance is due to its influence on the structure of the paper coating because the adsorption of the nonionic cellulosic causes (partial) flocculation of the clay particles at high paper coating, solids content. Beyond these advantages, hydrophobically modified hydroxyethylcellulose (HMHEC), like Natrosol® Plus grade 330 polymer from the Aqualon Company, a Division of Hercules Incorporated, provides high thickening efficiency with higher pseudoplasticity in high solids content coating compositions due to association between the hydrophobes in the HMHEC and other ingredients present in the paper coating, e.g., the binder. During blade coating, a hydrophobically modified cellulosic allows lower blade pressures, which can result in reduced water loss to the paper stock, web breaking and streaking, particularly at high speed, as described in U.S. Pat. No. 4,994,112. Also, the associative character of the thickener gives a faster immobilization of the paper coating after the blade due to quick structure reformation and thus a better coating holdout, resulting in improved optical and printability properties of the coated paper.

However, the degree of thickener adsorption must be limited, as over-flocculation can occur, initially resulting in a so called "pigment shock" that is caused by the bridging flocculation of clay particles by the co-binder molecular. This is often the case when nonionic polysaccharides are involved, especially in combination when European kaolin clays are involved, which are known for their strong adsorbing character. As well as the undesired pigment shock, over flocculation causes poor water retention and high blade load, thus poor runnability of the coating systems. In cases where the thickener has an associative character (HMHEC), a too high level of adsorption has an even more detrimental effect. The benefit of the associative character is diminished when an insufficient amount of thickener is present in the water phase of the coating color due to a high level of adsorption of that thickener onto the pigment.

It is known from the literature that, in addition to nonionic polysaccharides like HEC and HMHEC, hydrophilic nonionic polymers such as poly(vinyl alcohol) (PVOH) and polyethylene oxide (PEO) adsorb in substantial amounts onto clay surfaces. This is particularly the case when European kaolin clays are involved.

Equilibrium adsorption experiments for individual polymers in an aqueous suspension of clay particles have indicated that PVOH is adsorbed to a greater extent than HEC. When the PVOH is present in a binary mixture with a cellulosic polymer, the amount of adsorbed cellulosic is diminished in comparison to the amount adsorbed when no competing polymeric species is present. For cases in which one polymer is permitted to reach an equilibrium between its presence in the water phase and on the clay surface, prior to the addition of a second polymer, the displacement of the first polymer by the second is dependent upon the particular nature of both polymers being present. It was found that PVOH is able to displace HEC and HMHEC significantly from the clay. This happens whether the thickeners are added as dry powders, as solutions or as fluid suspensions in aqueous or non-aqueous media.

This indicates that PVOH is preferentially adsorbed onto the clay surface and the strength of attachment is greater than for HEC and thus prevents adsorption of the HEC onto the clay surface.

Application of the present invention provides a means of preventing or minimizing the pigment shock by using so called blockers such as described above in combination with thickeners which have strong adsorbing tendencies towards clays. The molecular weight of the blockers should be low to prevent them from causing flocculation of the clay particles themselves. This blocking also forces the thickener to remain largely in the aqueous phase of the coating composition, making it better able to fill its desired function in the papermaking operation.

An optimal balance of co-binder adsorbed on the pigment surface and dissolved in the liquid phase is required to give the paper coating its preferred theology. The present invention enables one to control flocculation of those paper coatings, leading to substantial improvement of coating process performance in terms of pigment shock, dynamic water retention, coating holdout and coating rheology, particularly at high shear rates. In addition to blocking, the blockers might contribute their own beneficial properties to the coating property balance; PVA, for example, is known for its positive influence on the brightness of the coated paper and its positive effect on the boosting of optical brightening agents (OBA).

As to the materials, the pigment portion is generally an aqueous dispersion of coating grade clays such as kaolin clays. In conjunction with the clays there may also be added one or more of the following: Titanium dioxide, calcium carbonate, barium sulfate, talc, zinc sulfate, aluminum sulfate, calcium oxide reaction products and other similarly used materials.

Suitable thickeners for this invention are water soluble alkylhydroxyalkyl cellulose or hydroxyalkyl cellulose or a combination thereof as well as their hydrophobically modified analogues, the hydrophobically modified derivates being the most effective. A preferred hydrophobically modified cellulosic is Natrosol® Plus, a hydrophobically modified hydroxyethylcellulose, produced by the Aqualon Company, a Division of Hercules Incorporated. Depending upon the needs of the paper manufacturer, it may be desirable to use one or more hydrophobically modified polysaccharides in combination with HEC or CMC.

As to the blocker, low molecular weight polyols may be used, like PVOH, PEO, polypropylene glycol (PPG), polyvinyl pyrrolidone, lower molecular weight water soluble alkylhydroxyalkyl cellulosics and nonionic polyacrylamide and salts of polyacrylic acid and polymethyacrylic acid are also effective. In order to obtain the full advantage of blocking, the blocker should not exceed a certain molecular weight, as it may function as a flocculant itself at higher molecular weight. For that reason, the optimum molecular weight for PEO is in the range of 1000–50,000. The optimum range for PVA is in the range of 5000–50,000. For the practice of the invention, the PVA can be 70–90, preferably 85–90 and most preferably 87–89 mol. % hydrolyzed.

In preparing the coating material, an aqueous slurry of the pigment is prepared by admixing the clay and other additives in a water system. pH is preferably in the alkaline range, between about 7.2–12. The pigment slurry is generally prepared as a dispersion of solids in the range of about 40–80% by weight, the higher range being preferred as in the range 60–70% solids for reasons including economy of handling.

The blocker can be added before or together with the thickener, as a powder, a fluid suspension or as a solution. In order to prevent or minimize pigment shock, it is important that the blocker reaches the pigment surface in a dissolved state before the thickener. Depending upon factors like pigment composition, type and molecular weight of the blocker and the type of thickener, the blocker is used in weight portion of from 0.005–2% on the weight of pigment solids (clay and other pigments). Proportions outside of this range are considered either inoperative below the lower range or uneconomic above the upper range.

EXAMPLE 1

This example illustrates the effect of several cellulosic co-binders on the pigment shock related to the percentage co-binder being adsorbed onto the clay surface. Pigment slurries containing 60% solids were prepared based on formulation 1. The data in Table 1 show that application of nonionic hydroxyl-rich water soluble polysaccharides can result in severe pigment shock, being related to the amount of adsorbed polysaccharide. Pigment shock was quantified by measuring the maximum torque onto the stirrer upon addition of a 7.5% thickener solution in water onto the slurry. The relative torque values are used to indicate whether or not the blocker is effective by controlling the flocculation. Four hours after preparation, the Brookfield RVT viscosity was measured at 100 rpm and 25° C. The amount of adsorbed thickener was established by determination of the thickener amount being present in the water phase after centrifuging the system 24 hours later for 2 hours at 30,000 g. Analyses were done according to the anthrone colorimetric method as described in Hercules Bulletin VC 507.

Formulation 1

| Ingredient | Parts by Weight (based on dry or 100% active materials) |
|---|---|
| SPS | 100 |
| Dispex N40 | 0.25 |
| NaOH | 0.1 |
| Co-binder | Variable |

SPS - Pigment, kaolin clay, ECCI
Dispex N40 - Clay dispersant, allied colloids

TABLE 1

| Co-binder | Amount* | Viscosity (mPa · s) | Torque (mNm) | Adsorbed (%) |
|---|---|---|---|---|
| Natrosol ® 250 LR | 0.3 | 1200 | >>100 | 99 |
| Natrosol Plus ® grade 330 | 0.3 | 1500 | >>100 | 100 |
| CMHEC 37L | 0.8 | 1300 | 35 | 39 |
| Blanose 7L2C | 1.0 | 1200 | 22 | 9 |

Natrosol ® 250 LR - Hydroxyethylcellulose, Aqualon BV
Natrosol Plus ® grade 330 - Hydrophobically modified hydroxyethylcellulose, Aqualon BV
CMHEC 37L - Carboxymethylhydroxyethylcellulose, Aqualon
Blanose 7L2C - Carboxymethylcellulose, Aqualon France SA
*Amount of thickener is expressed as parts on 100 parts of pigment

EXAMPLE 2

This example illustrates that PVOH acts as a blocker by preferential adsorption in a pigment system which includes a strongly adsorbing kaolin clay. By using the formulation and procedure as described in Example 1, Table 2 shows that both intensity and duration of the pigment shock caused by strong adsorption of HMHEC onto SPS clay can be significantly reduced by using PVOH, indicating that the degree of flocculation is controlled. Natrosol Plus® grade 330 was used at a level of 0.35 parts on 100 parts clay.

TABLE 2

| Poly(vinyl alcohol) | Mw (min.) | Amount | Torque (mNm) | T1 (s) | T2 (min.) |
|---|---|---|---|---|---|
| None (control | | | >>100 | 130 | >10 |
| Airvol 203 | 10,000 | 0.1 | >100 | 50 | 6 |
| Airvol 203 | 10,000 | 0.5 | 92 | 1 | 3 |
| Poly(vinyl alcohol) | 13,000 | 0.1 | >100 | | 7 |
| Poly(vinyl alcohol) | 13,000 | 0.5 | 95 | | 3 |
| Polyviol M13/140 | 49,000 | 0.1 | >100 | | >10 |
| Polyviol M13/140 | 49,000 | 0.5 | >100 | | >10 |
| Polyviol W25/140 | 79,000 | 0.1 | >>100 | | >10 |
| Polyviol W25/140 | 79,000 | 0.5 | >>100 | | >10 |

Airvol 203 - Air Products
Poly(vinyl alcohol) - Aldrich Chemicals, PVA being 87–89 mol. % hydrolyzed
Polyviol M13/140 - Wacker
Polyviol M25/140 - Wacker T1 expresses the time at which the maximum torque has been measured, calculated from the moment of co-binder/blocker addition.

T2 gives the time it takes before the viscosity curve has leveled off, indicating that the system has reached its equilibrium.

These data clearly show that optimum results are found in the lower Mw ranges.

EXAMPLE 3

By using the formulation and procedure mentioned in Example 2 and replacing SPS by a less strongly adsorbing kaolin clay like DB Plate, the use of PVA as blocker is even more pronounced. See data in Table 3.

TABLE 3

| Poly(vinyl alcohol) | Mw (min.) | Amount | Torque (mNm) | T1 (s) | T2 (min.) |
|---|---|---|---|---|---|
| None (control | | | 39 | 25 | 2 |
| Airvol 203 | 10,000 | 0.1 | 10 | 1 | <1 |
| Airvol 203 | 10,000 | 0.5 | 8 | 1 | <1 |
| Poly(vinyl alcohol) | 49,000 | 0.1 | 27 | 1 | <1 |
| Poly(vinyl alcohol) | 49,000 | 0.5 | 14 | 1 | <1 |

SPS has been replaced by DB Plate, a Kaolin clay delivered by Euroclay, at the same dosage.

EXAMPLE 4

This example shows that PVOH diminishes the amount of HMHEC being adsorbed onto kaolin clay, using the formulation and procedure as described in Example 1. Polyviol M13/140 was used as a blocker at several dosages, preventing Natrosol Plus® grade 330 from adsorption onto DB Plate.

TABLE 4

| Poly(vinyl alcohol) (ppH)* | Thickener being adsorbed (%) |
|---|---|
| 0.0 control | 79 |
| 0.1 | 41 |
| 0.3 | 20 |
| 0.5 | 8 |

*Amount of poly (vinyl alcohol) is expressed as parts on 100 parts of pigment.

EXAMPLE 5

The effect of PEO on the adsorption level of HMHEC is shown in this example, using the same set-up as in Example 4, except that Polyviol M13/140 was replaced by Lutrol E4000, a PEO produced by BASF, having an average molecular weight of 4000.

TABLE 5

| Poly(vinyl alcohol) (ppH)* | Thickener being adsorbed (%) |
|---|---|
| 0.0 control | 79 |
| 0.1 | 26 |
| 0.3 | 24 |
| 0.5 | 19 |

*Amount of poly (vinyl alcohol) is expressed as parts on 100 parts of pigment.

EXAMPLE 6

This example illustrates that PEO is able to reduce or prevent pigment shock by preferential adsorption onto kaolin clay. Referring to the formulation and procedure as described in Example 1, Table 6 shows that the intensity of the pigment shock caused by strong adsorption of HMHEC onto DB Plate can be significantly reduced by using PEO. Natrosol Plus® HMHEC grade 330 was used at a level of 0.35 parts on 100 parts of clay. After this, DL 945, a styrene butadiene latex produced by Dow Chemical Co., was added as the binder to the pigment slurry, prior to the addition of the thickener/blocker combination. This was done at a binder level of 10 parts on 100 parts DB Plate, based on dry material.

TABLE 6

| Mw PEO | PEO Level (ppH)* | Torque (mNm) |
|---|---|---|
| — | 0.0 control | 23 |
| 4000 | 0.1 | 12 |
| 4000 | 0.5 | 8 |
| 6000 | 0.1 | 11 |
| 6000 | 0.1 | 7 |
| 8000 | 0.5 | 7 |
| 15000 | 0.1 | 11 |

*Amount of PEO is expressed as parts on 100 parts of pigment.

EXAMPLE 7

This example illustrates that the blocking principle is also very effective with PEO in combination with a strongly adsorbing clay by using the description of Example 6, except that DB Plate has been replaced by SPS clay.

TABLE 7

| Mw PEO | PEO Level (ppH)* | Torque (mNm) |
|---|---|---|
| — | 0.0 control | 100 |
| 4000 | 0.5 | 13 |

*Amount of PEO is expressed as parts on 100 parts of pigment.

EXAMPLE 8

This example illustrates that the blocking principle is effective in controlling the flocculation caused by polymer adsorption. Paper coatings at a solids content of 60% were prepared, based on formulation 2. Thickener dosage was adjusted to end up at a viscosity of 1000 mPa.s (see Table 8). CLC coater trial results reveal that the addition of PVOH led to reduced blade pressure, despite a higher Hercules viscosity. The reduction is explained as a result of an improved dynamic water retention due to controlled flocculation. This improvement is already indicated by the S. D. Warren retention time results (see Table 8).

| Formulation 2 | |
|---|---|
| Components | Parts (w/w) |
| Delaminated clay | 50 |
| American clay no. 2 | 50 |
| Dispersant | 0.15 |
| SB latex | 7 |
| Nopcote 104 | 1 |
| Foamaster VF | 0.1 |

-continued

| Formulation 2 | |
|---|---|
| Components | Parts (w/w) |
| Thickener | varied |

TABLE 8

| Thickener(1) | Dose(2) | Hercules(3) | WRT(4) | BPI(5) |
|---|---|---|---|---|
| HMHEC/PVOH, 100/0 | 0.38 | 81.5 | 7 | 27.0/32.0 |
| HMHEC//PVOH, 75/25 | 0.43 | 87.5 | 8 | 25.0/28.0 |

(1)HMHEC - Natrosol Plus ® Grade 330 ex Aqualon BV
PVOH - Airvol 803 ex Air Products
(2)Parts per 100 parts of pigment.
(3)Hercules high shear viscosity (mPa · s).
(4)S. D. Warren water retention time(s).
(5)Blade pressure index, which indicates the amount of blade run-in required to give the target coat weight, 7.4 g/m$^2$. The lower BPI values on the left side were measured at 920 m/min., while the values on the right side were measured at 1220 m/min.

EXAMPLE 9

This example illustrates that the blocking principle is also applicable to hydrophobically modified ethylhydroxyethyl cellulose (HMEHEC), using the same set up as mentioned in Example 6, except that Natrosol Plus® Grad 330 polymer is replaced by Bermocoll EHM 100 polymer, an HMEHEC produced by Berol Nobel.

TABLE 9

| Blocker | Amount*** (ppH) | Torque (mNm) | T1**** (s) | T2[a] (min.) | Thickener being adsorbed (%) |
|---|---|---|---|---|---|
| None (control) | | 19 | 35 | 2 | 75 |
| Airvol 203* | 0.1 | 8 | 1 | <1 | 22 |
| Airvol 203 | 0.5 | 6 | 1 | <1 | 0 |
| Lutrol E 4000** | 0.1 | 7 | 1 | <1 | |
| Lutrol E 4000 | 0.5 | 5 | 1 | <1 | |

*Airvol 203 - Air Products (PVA)
**Lutrol E 4000 - HASF (PEO)
***Amount of blocker is calculated on the amount of clay
****T1 expresses the time at which the maximum torque has been measured, calculated from the moment of thickener addition
[a]T2 gives the time it takes before the viscosity curves have levelled off, indicating that the system has reached its equilibrium.

EXAMPLE 10

This example shows that the blocking principle is also very effective with alkylaryl ethoxylates. Referring to the formulation and procedure in Example 6, Table 10 visualizes that the intensity of the pigment shock caused by strong adsorption of HMHEC onto DB Plate can be significantly reduced by Antarox CO 970 polymer, a nonylphenol ethoxylate (50 EO units) produced by GAF.

TABLE 10

| Blocker | Amount (ppH) | Torque (mNm) | T1 (s) | T2 (min.) |
|---|---|---|---|---|
| None (control) | | >>100 | 130 | >10 |
| Antarox CO 970 | 0.5 | 81 | 1 | 5 |

What is claimed is:

1. A paper coating composition comprising a clay-containing pigment system, a binder, a polysaccharide thickener selected from the group consisting of a water soluble alkylhydroxyalkylcellulose, hydroxyalkylcellulose, carboxymethylhydroxyethylcellulose, a hydrophobically modified hydroxyalkylcellulose, alkylhydroxyalkylcellulose, carboxyalkylhydroxyalkylcellulose, and mixtures thereof and at least 0.005%–2%, based upon the weight of the pigment, of a blocking agent selected from the group consisting of poly(vinyl alcohol) having a molecular weight in the range of 4,000–50,000, poly(ethylene oxide) having a molecular weight in the range of 1,000–50,000, alkylethoxylate or an alkylaryl ethoxylate containing at least 25 oxyethylene units, and protein and serves to prevent more than 25% of the polysaccharide thickener from being adsorbed onto the clay pigment surface.

2. The composition of claim 1, wherein the pigment includes one or more materials selected from the group consisting of titanium dioxide, calcium carbonate, barium sulfate, talc, zinc sulfate or the reaction product of aluminum sulfate and calcium oxide.

3. The composition of claim 1, wherein the polysaccharide thickener is hydrophobically modified hydroxyethylcellulose.

4. The composition of claim 3, wherein the hydrophobic modification is a $C_{10}$–$C_{24}$ alkyl group, a $C_{10}$–$C_{24}$ alkylaryl group or a $C_{10}$–$C_{24}$ alkyl or alkaryl group connected to the polysaccharide by 1 to 5 oxyethylene groups.

5. The composition of claim 1, wherein the polysaccharide thickener is hydrophobically modified ethylhydroxyethylcellulose.

6. The composition of claims 5, wherein the hydrophobic modification is a $C_{10}$–$C_{24}$ alkyl group, a $C_{10}$–$C_{24}$ alkylaryl group or a $C_{10}$–$C_{24}$ alkyl or alkaryl group connected to the polysaccharide by 1 to 5 oxyethylene groups.

7. The composition of claim 1 wherein the blocking agent and thickener are a fluidized suspension in an aqueous or non-acqueous carrier fluid.

* * * * *